US006495783B2

(12) United States Patent
Rochon et al.

(10) Patent No.: US 6,495,783 B2
(45) Date of Patent: Dec. 17, 2002

(54) PUSH ACTUATED ELECTRICAL SWITCH

(75) Inventors: Sylvain Rochon, Dole (FR); Laurent Bouvier, Dole (FR); Thierry Burnel, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/738,298

(22) Filed: Dec. 14, 2000

(65) Prior Publication Data

US 2001/0020577 A1 Sep. 13, 2001

(30) Foreign Application Priority Data

Dec. 30, 1999 (FR) ..... 99 16725

(51) Int. Cl.[7] ..... H01H 5/30
(52) U.S. Cl. ..... 200/406; 200/529; 200/533
(58) Field of Search ..... 200/406, 535, 200/529, 542, 545, 551

(56) References Cited

U.S. PATENT DOCUMENTS 3,676,625 A * 7/1972 Blatt ..... 200/542
4,153,829 A * 5/1979 Murata ..... 200/533
4,563,555 A * 1/1986 Ohtani ..... 200/533 X
4,803,316 A * 2/1989 Hayashi et al. ..... 200/406
5,660,272 A 8/1997 Janniere et al. ..... 200/533 X
6,018,132 A * 1/2000 Chen ..... 200/406

FOREIGN PATENT DOCUMENTS

FR 2 771 846 A1 6/1999

* cited by examiner

*Primary Examiner*—Renee Luebke
(74) *Attorney, Agent, or Firm*—Roger C. Turner

(57) ABSTRACT

A miniature electrical switch is closed when a pusher (44) is pushed forwardly (F) to snap down a snap dome tripping member(36) and push a contact blade (50) against a contact part (28). Forward sliding of the actuator is converted into downward movement of the snap dome, by a rigid lever (48) of generally T shape, with a rear branch (51) having laterally spaced trunnions (60) for pivoting and a center section (52) with a cam follower upper surface (76). A ramp (94) at the front of the push member depresses the cam follower as the actuator slides forward. The trunnions are of largely rectangular cross section and pivot on an edge (130).

3 Claims, 4 Drawing Sheets

PUSH ACTUATED ELECTRICAL SWITCH

CROSS-REFERENCE TO RELATED APPLICATION

Applicant claims priority from French application 99/16725 filed December, 1999.

BACKGROUND OF THE INVENTION

One type of miniature switch (e.g. 1 to 3 mm high) includes an actuator that can be pushed forward to depress a conductive member against a contact and thereby close the switch. One example of such miniature switch is shown in an earlier patent by one of the present inventors, U.S. Pat. No. 5,660,272, which shows a resilient sheet metal force-transmitting member that converts forward movement of the actuator into downward depression of a snap dome tripping member. Such sheet metal transfer member includes a plate that facilitates mounting of the transfer member on a miniature housing. However, such transfer member requires intricate bending of a tiny piece of sheet metal. A simpler and more rugged force transfer member which was also simple to mount in a miniature housing and which reduced the height of the switch, would be of value.

SUMMARY OF THE INVENTION

In accordance with one embodiment of the present invention, a miniature electrical switch is provided, which includes an actuator that can be pushed forwardly to operate the switch and a contacting device with a portion that can be depressed to push down an electrical conductor against a contact to close the switch. The switch includes a force transfer member in the form of a one-piece rigid molded lever that is pivotally mounted on the housing. The lever has a cam follower surface that is depressed by a ramp surface at the front end of the actuator, with the lever having a lower surface positioned to depress the contacting device.

The lever has a laterally-elongated rear branch forming trunnions at its laterally opposite sides. The trunnions fit into trunnion-receiving recesses in the housing, with the trunnions being pivotable on the housing to allow the lever to pivot. Each of the trunnions is of largely rectangular cross section, with corners joining the faces of the rectangle. A corner of the rectangle cross section, and therefore on edge of each trunnion, pivots on the housing for very simple mounting and low friction rocking pivoting.

The novel features of the invention are set forth with particularity in the appended claims. The invention will be best understood from the following description when read in conjunction with the accompanying drawings.

DESCRIPTION OF THE PREFERRED EMBODIMENT

Figure 1:
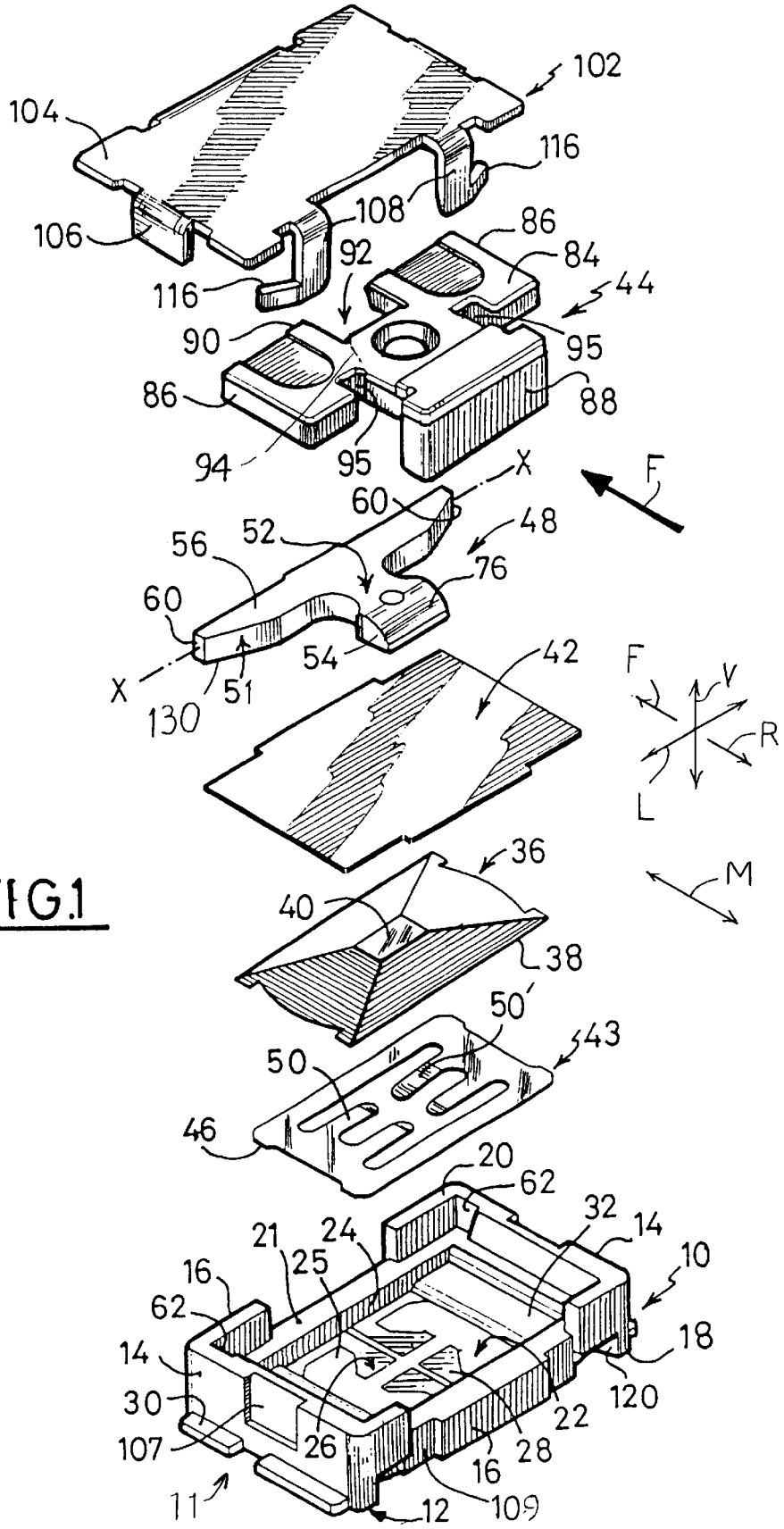
FIG. 1 is an exploded top isometric view of an electrical switch of the invention.

FIG. 1 illustrates an electrical switch 10 with a housing 11 that includes a one-piece polymer molded body 12 and a sheet metal cover 102 that covers the body. The body has laterally L spaced sides 14, front F and rear R ends 16, a lower face 18 and an upper face 20. An upwardly-opening cavity 22 is partially surrounded by the sides and ends of the body. The cavity has a peripheral wall 24 that forms a rectangular cavity with a bottom 25 which lies in a horizontal plane that is parallel to the upper face 20. Four electrical contacts 26 are mounted in the body 12 by overmolding the body around the contacts. The contacts have planer engaging parts 28 that lie at the bottom of the cavity and flush with the rest of the cavity bottom. The contacts also have outer ends 30 that are accessible from the outside of the body. Each switch is designed for mounting on a circuit board, wherein the contact outer ends 30 may be soldered or otherwise connected to traces on the circuit board.

The body has two raised platforms 32 at laterally opposite sides of the cavity, with each platform having a chamfered end leading to the bottom 25 of the cavity. A contact part in the form of a contact plate 43 which is formed of sheet metal, has laterally opposite edges 46 that rest on the platforms 32. The contact plate has contact blades 50 that can be downwardly depressed against the planar parts 28 of the corresponding contacts. It is noted that one of the blades 50' is permanently bent downwardly to lie in constant engagement with one of the contact planar parts.

The switch includes a snap dome tripping member 36. Both the tripping member 36 and the contact plate 43 lie in the body 12 of the housing. To lie in a rectangular cavity, the particular tripping member has a rectangular periphery 38. The tripping member has a central upper part 40 that can be depressed. At a predetermined amount of depression of the central part 40, it suddenly offers a decreased upward bias and the central part can snap down. This transmits a tactile sensation to an actuator 44 which in the form of a pusher member with a face 88 that is pushed to close the switch. In one example, the actuator is pushed by a card that is inserted into a card reader by a person's fingers.

The contact plate 43 is formed of sheet metal, and its middle lies vertically V between the tripping member 36 and the fixed contacts 26. With the laterally opposite edges 46 of the contact plate lying on the platforms 32, the middle of the contact plate lies a distance above the bottom of housing, and therefore above the contact planar parts 28. As a result, the blades 50 of the contact plate initially lie directly over but are spaced from the planar parts 28 of the contacts.

A protective and sealing double film 42 lies above the tripping member 36. The film 42 has an adhesive face sealed to the upper face 21 of a body shoulder, to seal the cavity 22 in which the tripping member 36 and contact plate 43 lie. The combination of tripping member 35 and contact plate 43 forms a contacting device that can be pushed down to engage a contact with blades of the contact blade forming contacting parts. While applicant prefers to use a snap dome tripping member and a contact plate, it is possible to use contacting devices of other constructions. For example, the tripping member can directly engage a contact, or a deflectable blade alone can be used without a snap dome.

The tripping member 36 is depressed by a mechanism that includes the pusher member or actuator 44 and a lever 48. The pusher member or pusher 44 can slide in forward and rearward longitudinal M directions, while the lever can pivot about a laterally-extending pivot axis XX. The pusher 44 is a single integral piece that is molded of a polymer. It has a lower face 82 (FIG. 2), a parallel upper face 84 (FIG. 1), two side faces 86, a rear actuating face 88, and a front end 90.

Figure 5:
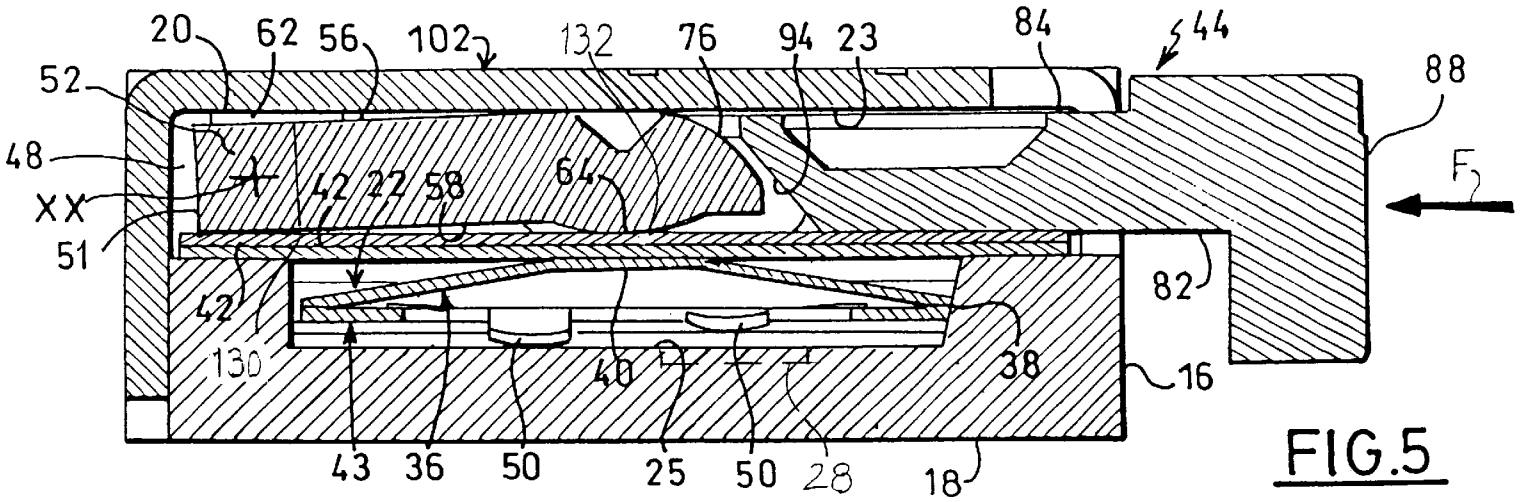
FIG. 5 is a sectional view taken on line 5—5 of FIG. 3.
Figure 4:
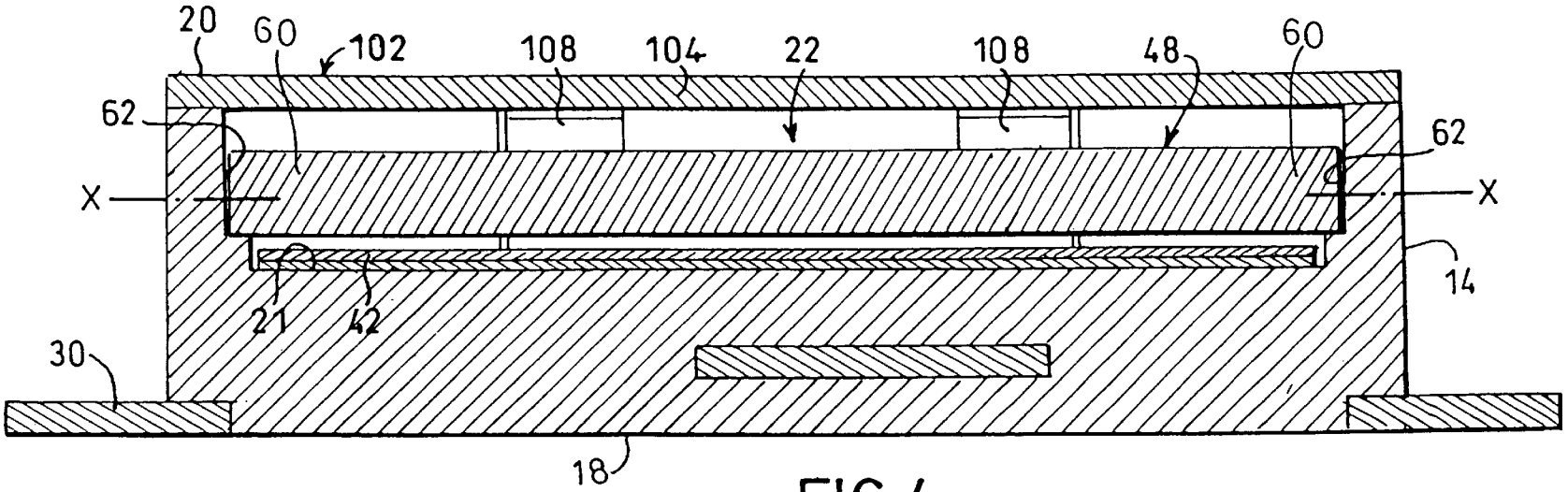
FIG. 4 is a sectional view taken on line 4—4 of FIG. 3, but showing details of only part of the switch.

The front end has a central recess 92 whose rear end forms a camming surface in the form a ramp 94. FIG. 5 shows that the ramp 94 is designed to contact a cam follower 76 formed by a convexly curved surface of the lever 48 that extends at a rearward-downward incline. All of the elements of the switch are held in a vertical stack by the cover 102 which is formed of cut and bent sheet metal.

FIG. 1 shows that the cover has a continuous substantially rectangular upper horizontal wall 104 lying in a horizontal plane. This wall 104, which is at the top of the switch, allows for easy grasping of the switch by a suction pickup for automatically mounting the miniature switch on a circuit board. A pair of tabs 106 depend from laterally opposite sides of the wall, and slide down into recesses 107 in the body 12. The cover has two tabs 108 that extend downwardly from the rear edge of the upper wall. The tabs lie in recesses 109 in the rear face 16 of the body 12. The rear tabs 108 form a cutout 110 (FIG. 2) between them for sliding movement of the pusher 44.

Figure 2:
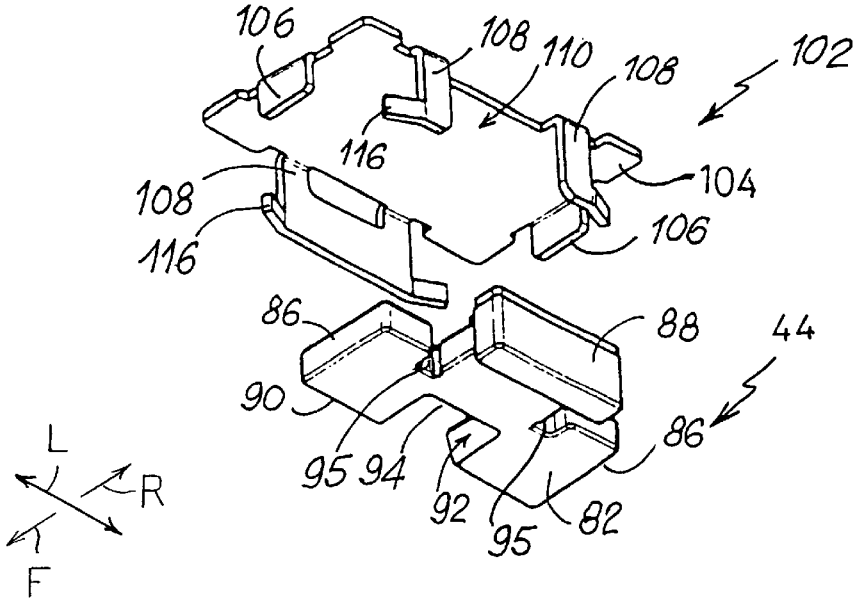
FIG. 2 is an exploded bottom isometric view of the switch.
Figure 2:
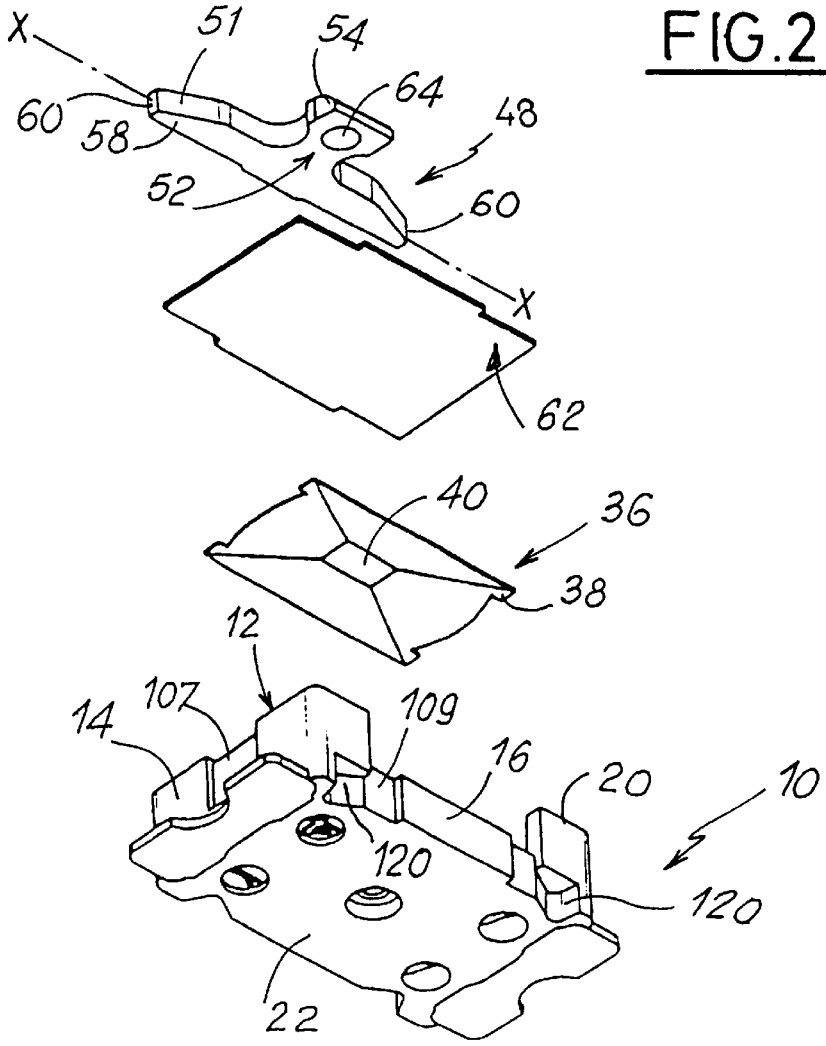
Figure 3:
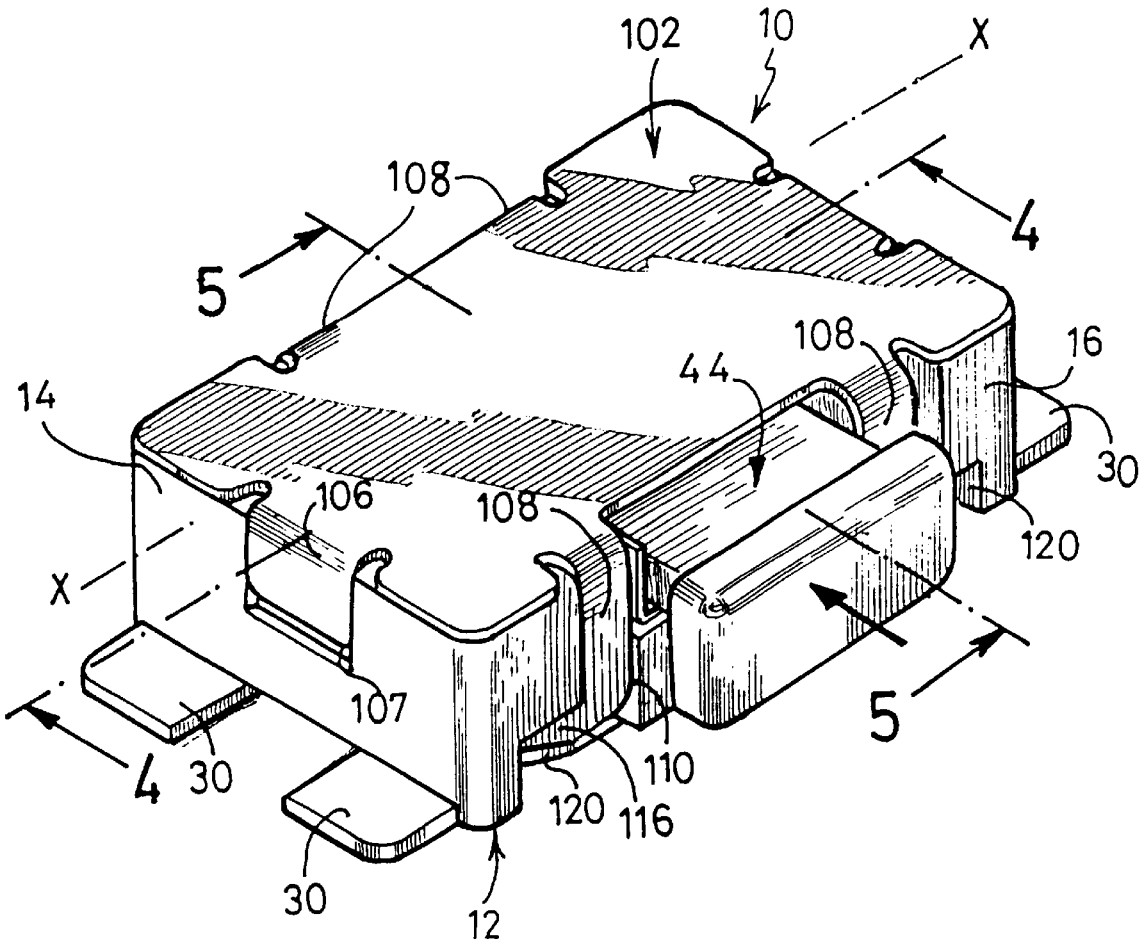
FIG. 3 is a top isometric view of the switch of FIG. 1 in a fully assembled configuration.

The lower end of each rear tab 108 has an extension 116 that is slightly bent forward. The tab extensions 116 can be deformed into recesses 120 in the front and rear faces of the body, to lock the cover on the body. It is noted that at the front of the cover, there is only a thin cutout between the two frontmost tabs 108. FIG. 2 shows that the rearmost tabs 108 can abut rearwardly-facing shoulders 95 that lie in rear grooves of the pusher to prevent the pusher from being pulled rearwardly out of the housing.

As shown in FIG. 1, the lever 48 is a single molded piece that is molded of a plastic. The lever has a largely T shape, with a rear branch 51 and a narrower central branch 52 that extends rearwardly from the lateral middle of the rear branch. The lever has upper and lower faces 56, 58 (FIG. 2). Each of the laterally opposite sides of the rear branch 51 constitutes a trunnion for pivotal mounting of the lever in pivoting about the horizontal laterally-extending axis XX. FIG. 1 shows that the housing has a pair of laterally-spaced bearing recesses 62 for receiving the trunnions formed by the laterally opposite ends 60 of the lever. Each recess 62 opens upwardly, to allow the trunnions of the lever to be dropped into the recesses before the cover 102 is placed over them.

As shown in FIG. 2, the central branch 52 has a rear end 54 with a downwardly-projecting boss 64 that is spherically curved (curved about two perpendicular axes). As shown in FIG. 5, the boss 64, which serves as a depresser, lies directly over the central part 40 of the tripping dome, with only the film 42 lying between them. A spherical boss makes a point or spot contact with the tripping member, which is especially effective in causing a downward snap.

FIG. 5 shows the switch in its rest position, wherein the switch is open. When a user pushes forwardly F against the rear face 88 of the pusher (e.g., by pushing a card whose leading edge pushes against the face 88), and the pusher slide forwardly. The ramp 94 pushes against the curved cam follower surface 76 of the lever, to pivot the lever clockwise about the axis of pivoting XX. The cam follower surface 76 is a part cylindrical surface with an axis at 132. The boss 64 depresses the central part 40 of the tripper, which pushes down the contact blades 50 so they engage the planar parts 28 of the contacts that lie flush with the bottom 25 of the cavity. When the rearward force on the pusher rear face 88 is released, the contact plate 43 and tripping member move upwardly to release the energy that they have stored during downward resilient deflection, to return the lever 48 to its upward position. During upward lever pivoting, the lever surface 76 pushes the pusher 44 rearwardly to its initial position.

FIG. 1 shows that the ends or trunnions 60 of the lever rear branch are of substantially rectangular cross-sections. This results in a corner at a front and lower edge 130 of the trunnions. The trunnions pivot, or rock, on this edge 130, on the upper face 21 of the body. Actually, the housing face is covered by the film 42, and the trunnions pivot on the film. This provides low friction pivoting. It also allows low cost construction of the molded lever and molded body 12. An alternative would be to form the trunnions at 60 with tiny cylindrical surfaces and to form the recesses 62 with corresponding cylindrical surfaces. The molding of tiny cylindrical surfaces would be more expensive and result in higher pivoting friction.

In a switch of the construction illustrated in the drawings that applicant has designed, the total height of the switch was less than 1.4 mm and its length in the longitudinal direction M was less than 4.4 mm. Such a very small height and length is required in many applications, as in portable electronic devices, where the switch may be used to detect the full insertion of a smart card. Applicants' one-piece molded lever 48 has a small height, compared to the force transfer member of applicant's U.S. Pat. No. 5,660,272, which enables construction of a switch of especially small thickness or height, which is rugged, and which is of low cost.

While applicant has used terms such as "top", "bottom", "horizontal", etc., to help describe the invention as illustrated in the drawings, it should be understood that the invention can be used in any orientation with respect to the Earth.

Thus, the invention provides a miniature switch of the type that is actuated by pushing horizontally forward against a push member to cause a force transmitter means to move down a contacting device to close (or open) a switch, where the force transmitting member is of small height, low cost, and rugged. This is accomplished by using a lever with a front branch that is pivotally mounted on the housing and with a central branch with a rear end forming a cam follower that is depressed by a ramp at the front end of the pusher. A part-spherical boss at the lower end of the central branch front end pushes down against the middle of a tripper of the contacting device, to push down blades of a contact plate against planar parts of contacts to close the switch(es). The lever front branch has laterally opposite sides forming trunnions of largely rectangular cross sections with corners or edges that pivot on an upper surface of the body.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical switch which includes a housing, at least a first contact mounted on said housing, a contacting device lying in said housing and having a contacting part that can be depressed downwardly against said first contact to electrically engage the first contact, and an actuator that is slideable in forward and rearward longitudinal directions on said housing with said actuator having a rear pushing surface that can be pushed forwardly and a front camming surface that can operate the switch, comprising:

a rigid lever that is pivotally mounted on said housing to pivot about a primarily horizontal axis, said lever having a cam follower positioned in the path of said camming surface so when said actuator is slid forward said camming surface slides on said cam follower and moves said cam follower partially vertically to pivot said lever, said lever having a depresser that depresses said contacting device to depress said contacting part against said first contact;

said lever has a front branch with laterally opposite sides that are spaced in a lateral direction that is horizontal and perpendicular to said longitudinal directions, with said opposite sides each forming a trunnion and with said housing having a pair of trunnion-receiving recess that receive said trunnions;

said lever has a center branch that projects rearwardly from said front branch, with said center branch having a rear upper surface forming said cam follower;

said trunnions each have a pair of adjacent flat faces joined by a corner edge that extends primarily laterally, with each trunnion pivoting on its corner edge on a surface of said housing.

2. An electrical switch which includes a housing, at least a first contact mounted on said housing, a contacting device lying in said housing and having a contacting part that can be depressed downwardly against said first contact to electrically engage the first contact, and an actuator that is slideable in forward and rearward longitudinal directions on said housing with said actuator having a rear pushing surface that can be pushed forwardly and a front camming surface that can operate the switch, comprising:

a rigid lever that is pivotally mounted on said housing to pivot about a primarily horizontal axis, said lever having a cam follower positioned in the path of said camming surface so when said actuator is slid forward said camming surface slides on said cam follower and moves said cam follower partially vertically to pivot said lever, said lever having a depresser that depresses said contacting device to depress said contacting part against said first contact;

said lever has a front branch with laterally opposite sides that are spaced in a lateral direction that is horizontal and perpendicular to said longitudinal directions with said opposite sides each forming a trunnion, and with said housing having a pair of trunnion-receiving recess that receive said trunnions;

said lever has a center branch that projects forwardly from said front branch, with said center branch having a rear upper surface forming said cam follower;

said center branch of said lever has a smaller width in a lateral direction, than said front branch;

said actuator has a front with a central recess extending rearwardly from said front, with said center branch fitting into said central recess, and with said actuator camming surface lying at the rear of said central recess.

3. An electrical switch which includes a housing, at least a first contact mounted on said housing, a contacting device lying in said housing and having a contacting part that can be depressed downwardly against said first contact, and an actuator that is slideable in forward and rearward longitudinal directions on said housing, with said actuator having a pushing surface that can be pushed forwardly and a camming surface, comprising:

a lever of generally T shape, with a front branch having laterally opposite sides spaced in horizontal directions that are perpendicular to said longitudinal directions, with said housing having trunnion receiving recesses that limit movement of the trunnions while allowing the trunnions to pivot about a laterally-extending axis;

said lever having a center branch that extends rearwardly from said front branch and that has an upper surface forming a cam follower that is depressed by said actuator camming surface when said actuator is pushed forwardly, said center branch having a lower surface positioned to depress said contacting device when said upper surface is depressed;

said housing has a bottom recess wall at the bottom of each of said recesses;

said trunnions each have a pair of adjacent flat faces joined by a corner edge that extends primarily laterally and that can rock on one of said recess walls.

* * * * *